US007299643B2

(12) United States Patent
McCoy

(10) Patent No.: US 7,299,643 B2
(45) Date of Patent: Nov. 27, 2007

(54) METHOD FOR RECOVERING LPG BOIL OFF GAS USING LNG AS A HEAT TRANSFER MEDIUM

(75) Inventor: Michael Monroe McCoy, Sugar Land, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 11/187,214

(22) Filed: Jul. 21, 2005

(65) Prior Publication Data

US 2006/0065014 A1 Mar. 30, 2006

Related U.S. Application Data

(60) Provisional application No. 60/614,661, filed on Sep. 29, 2004.

(51) Int. Cl.
*F17C 9/02* (2006.01)
*F17C 3/10* (2006.01)
*F25J 1/00* (2006.01)

(52) U.S. Cl. ..... 62/50.2; 62/614; 62/48.2

(58) Field of Classification Search ..... 62/620, 62/630, 50.2, 611, 614, 48.2
See application file for complete search history.

(56) References Cited

U.S. PATENT DOCUMENTS 3,253,418 A * 5/1966 Harmens ..... 62/50.3
3,456,032 A * 7/1969 Ludwig ..... 585/650
3,656,312 A * 4/1972 Streich ..... 62/630
3,861,461 A 1/1975 Kissinger
3,887,003 A 6/1975 Polcer et al.
4,036,028 A * 7/1977 Mandrin ..... 62/50.3
4,431,049 A * 2/1984 Zamma et al. ..... 165/142
4,446,703 A 5/1984 Gilbertson
4,479,350 A * 10/1984 Newton et al. ..... 60/655
4,479,535 A 10/1984 Echigo et al.
4,745,768 A 5/1988 Schorr et al.
5,128,292 A 7/1992 Lomas
5,177,979 A 1/1993 Gianfrancesco
6,470,706 B1 10/2002 Engdahl
6,793,712 B2 * 9/2004 Qualls ..... 95/92
2004/0182752 A1 9/2004 Reyneke et al.
2005/0155381 A1 * 7/2005 Yang et al. ..... 62/620

OTHER PUBLICATIONS

Kern, Process Heat Transfer, McGraw-Hill Book Company, Inc., 1950, pp. 739-746, Bayonet Exchangers.

* cited by examiner

*Primary Examiner*—William C Doerrler
(74) *Attorney, Agent, or Firm*—James W. Ambrosius; Frank C. Turner

(57) ABSTRACT

A process for condensing a $C_3$-$C_4$ hydrocarbon vapor which comprises contacting the $C_3$-$C_4$ hydrocarbon vapor with a heat exchanger surface which is cooled by contact with LNG and recovering a liquefied $C_3$-$C_4$ product therefrom.

10 Claims, 2 Drawing Sheets

METHOD FOR RECOVERING LPG BOIL OFF GAS USING LNG AS A HEAT TRANSFER MEDIUM

CROSS REFERENCE TO RELATED APPLICATIONS

This application claims priority from U.S. Provisional Application No. 60/614,661 filed on Sep. 29, 2004, the entire contents of which are incorporated herein by reference.

FIELD OF THE INVENTION

The present invention involves a method for recovering LPG boil off gas using LNG as a heat transfer medium.

BACKGROUND OF THE INVENTION

Liquefied natural gas (LNG) is principally liquid methane, with smaller amounts of $C_{2+}$ hydrocarbons also present. It is prepared by chilling a raw natural gas stream to a temperature and at a pressure to cause at least a portion of the methane in the raw gas to condense as a liquid. The natural gas stream used to prepare LNG may be recovered from any process which generates light hydrocarbon gases. Generally, the raw natural gas from which LNG is prepared is recovered from a crude oil or gas well.

Raw natural gas, in addition to the presence of methane, typically will also include varying amounts of $C_{2-}$ hydrocarbons; $C_3$ hydrocarbons; and $C_4$ hydrocarbons. Natural gas which also comprises varying amounts of $C_{5+}$ hydrocarbons is referred to as "wet natural gas" while "dry natural gas" comprises little or no $C_{5+}$ hydrocarbons. As used herein, $C_1$ represents a hydrocarbonaceous compound having one carbon atom per molecule; $C_2$ has two carbon atoms per molecule, etc. $C_3$-$C_4$ represents a hydrocarbonaceous material, comprising predominately compounds having three carbon atoms per molecule and/or compounds having four carbon atoms per molecule. $C_{5+}$ represents compounds having five or more carbon atoms per molecule. Methane is a representative example of a $C_1$ compound and is the principal constituent of raw natural gas. Ethane, ethylene, and mixtures thereof are representative examples of a $C_2$ compound. Propane, propene, butane, butenes and mixtures thereof are representative examples of a $C_3$-$C_4$ compound. Pentanes, isobutane, pentenes, hexanes, hexenes and comparable higher molecular weight species, and their mixtures, are representative of $C_{5+}$ compounds.

The process of liquefying natural gas involves chilling the raw natural gas, either at atmospheric or super-atmospheric pressure, until the methane and ethane condense as liquids (LNG). On account of their higher molecular weights, any $C_{3+}$ vapors contained in the raw natural gas will condense prior to the condensation of the $C_1$ and $C_2$ compounds, forming a liquid product termed "natural gas liquids". Each of the components which condense during the preparation of LNG has important commercial value. As already noted, $C_1$ and $C_2$ compounds are the major components of LNG. Any heavier materials which are present in the raw natural gas are carefully removed prior to condensing the LNG. Liquefied petroleum gas (LPG), comprising $C_3$-$C_4$ hydrocarbons, is important as a refrigerant in the chilling process. LPG is also useful as a fuel in the LNG liquefaction process and has value as a transportation fuel. The $C_{5+}$ condensate recovered from the raw natural gas is valuable as a blending component for fuels, particularly for transportation fuels. It is therefore important that the liquefied $C_{5+}$ condensate and the $C_3$-$C_4$ LPG be prepared separately from the LNG. Where propane and/or butane are important products, they are stored in separate storage vessels as relatively pure hydrocarbons.

LPG (i.e., propane and butane) is typically stored in tanks at atmospheric or super-atmospheric pressure. The choice is primarily one of economics and compatibility with associated processes and equipment. LPG stored in tanks at atmospheric pressure is maintained at low temperatures (−40° F. for the propane and 0° F. for the butane) to maintain the material as a liquid. Heat absorbed into the tank from the surrounding ambient conditions cause both the propane and the butane to continuously boil off some amount of vapor, producing boil off gas (BOG). Typically, the propane and butane vapors are recovered by compressing the vapors with a screw or a reciprocating compressor from less than about 1 psig to about 200 psig and about 50 psig respectively, to reach the appropriate pressure-temperature equilibrium point (~100° F.) to allow a cooling water exchanger or a fin fan to provide sufficient heat removal to condense the vapors. Since propane and butane each condense at a different temperature, each stream requires a separate compressor, knockout drum, condensing exchanger and cooling medium. Furthermore, the propane and butane streams cannot be combined into one recovery stream as the combined stream will contaminate the pure component tank. The recovery systems also require some back-up power generation system to drive the compressors in the event of a power failure, since pressure cannot be allowed to build in the tank or vapors to be vented to atmosphere.

LNG storage tanks have a boil off gas (BOG) recovery system including a blower and a recovery line from the storage tanks to either a flare or a location in the LNG process that can recover the low pressure LNG vapor stream (blowers are typically used when a fairly low increase in pressure is required). See for example, U.S. Pat. No. 6,470,706.

The present invention is directed to an efficient process for preparing and storing separate LPG streams in the process of preparing LNG.

As used in this disclosure the word "comprises" or "comprising" is intended as an open-ended transition meaning the inclusion of the named elements, but not necessarily excluding other unnamed elements. The phrase "consists essentially of" or "consisting essentially of" is intended to mean the exclusion of other elements of any essential significance to the composition. The phrase "consisting of" or "consists of" is intended as a transition meaning the exclusion of all but the recited elements with the exception of only minor traces of impurities.

SUMMARY OF THE INVENTION

The present invention is directed to a process for condensing a $C_3$-$C_4$ hydrocarbon vapor which comprises contacting the $C_3$-$C_4$ hydrocarbon vapor with a heat exchanger surface which is cooled by contact with LNG and recovering a liquefied $C_3$-$C_4$ product therefrom. As used in this disclosure the phrase "$C_3$-$C_4$ hydrocarbon vapor" refers to a hydrocarbon vapor consisting essentially of hydrocarbons containing between three and four carbon atoms. Thus the phrase may refer to a hydrocarbon vapor consisting essentially of propane or a hydrocarbon vapor consisting essentially of n-butane. The phrase $C_3$-$C_4$ hydrocarbon vapor may also refer to a hydrocarbon vapor consisting essentially of a mixture containing one or more of propane, propene, n-butane, and butene.

In one embodiment of the process of the invention the heat exchange surface is contained in a bayonet exchanger. In an alternative embodiment the heat exchange surface is contained a condensing exchanger. Various other configurations of heat exchange devices are known to those skilled in the art and may be employed in carrying out the process of the invention.

Since liquefied propane is generally stored in vessels as relatively pure hydrocarbons, the present invention may also be described as a method of recovering $C_3$ boil off gas from a vessel containing liquefied $C_3$ which comprises contacting the $C_3$ boil off gas with a heat exchanger surface which is cooled by contact with LNG and recovering a liquefied $C_3$ product therefrom. The invention may also be described as a method of recovering $C_4$ boil off gas from a vessel containing liquefied $C_4$ which comprises contacting the $C_4$ boil off gas with a heat exchanger surface which is cooled by contact with LNG and recovering a liquefied $C_4$ product therefrom.

DETAILED DESCRIPTION OF THE INVENTION

In one embodiment of the present invention, the propane and butane are stored at atmospheric pressure. Preferably, within the LNG/LPG liquefaction facility, the LNG storage vessel and the LPG storage vessels are in close proximity to each other. In this configuration, the propane and butane boil off gases do not require compression to reach the appropriate pressure-temperature equilibrium point (−40° F. and 0° F., respectively) when the LNG stream is used to condense the vapors. The use of LNG to condense the propane and butane eliminates the compressors and emergency back up systems typically present in conventional LPG liquefaction facilities.

LNG stored at atmospheric pressure is at a temperature (about −150° F. or lower) which is lower than the condensation temperature of either $C_4$ or $C_3$. Thus, contacting $C_3$-$C_4$ vapors with LNG will cause at least a portion of the vapors to condense without the need for expensive compression. Further, condensing the $C_3$-$C_4$ vapors will result in some vaporization of the LNG. Therefore, a further aspect of the invention is the discovery that vaporizing LNG in order to condense $C_3$-$C_4$ vapors is preferred to condensing $C_3$-$C_4$ vapors using conventional methods. The LNG liquefaction system includes efficient methods for liquefying natural gas. Any $C_1$ or $C_2$ vapors generated during the liquefaction of $C_3$-$C_4$ is easily recondensed in the LNG process. In many situations, returning $C_1$ or $C_2$ vapors to the liquefaction process is more efficient than recondensing separate $C_3$-$C_4$ streams, as typically required in the conventional process.

Figure 1:
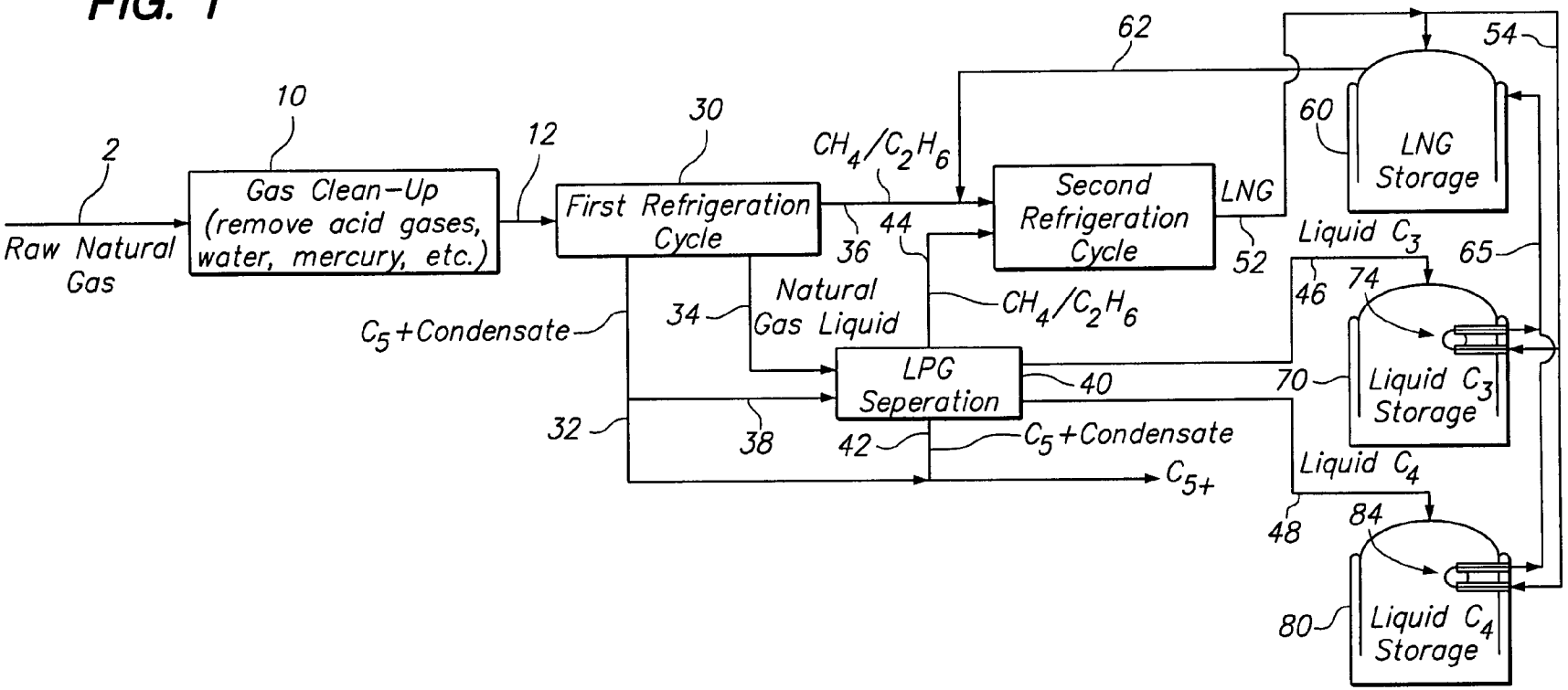
FIG. 1 is a schematic diagram of a LNG/LPG liquefaction facility in which bayonet heat exchangers are used to recover propane and butane boil off gas within their respective storage vessels.

FIG. 1 represents a LNG/LPG liquefaction facility which employs the present invention to recover LPG boil off gas. In FIG. 1, the raw natural gas stream (2) from which LNG is made is collected, either alone or in combination with heavier crude products, from a production well (not shown). The raw natural gas stream typically comprises methane, $C_2$-$C_4$ hydrocarbons, and generally lesser amounts of $C_{5+}$ condensate. The stream may also contain contaminants such as water, carbon dioxide, hydrogen sulfide, nitrogen, dirt, iron sulfide, wax, crude oil, diamondoids, mercury and the like. These contaminants are undesirable in the liquefied products and are generally removed prior to the refrigeration steps as they tend to cause problems during processing. Acid contaminants which may lead to corrosion of the refrigeration materials are also preferably removed. The contaminants may be removed by conventional means which are well known to those skilled in the art.

After the natural gas stream is cleaned to remove contaminants (10), it is chilled in a first refrigeration zone (30). The first refrigeration zone (30) may comprise one or more refrigeration cycles. Example coolants include LNG, LPG or mixtures thereof. The chilling process produces natural gas liquid (34) and often a separate $C_{5+}$ condensate stream (32). As shown in FIG. 1, the $C_{5+}$ condensate stream (32) removed from the first refrigeration zone may optionally be sent by line 38 to the LPG separation zone (40) for removing any $C_{4-}$ components (i.e., $C_4$ and lighter) which are contained in it.

Natural gas liquids (34) from the first refrigeration zone (30) are passed to the LPG separation zone (40) for isolation and recovery of separate liquid $C_3$ (46) and liquid $C_4$ (48) streams. These streams are stored in storage vessels 70 and 80, respectively. The LPG in stream 46 and in tank 70 comprises liquid $C_3$, usually referred to as simply propane. However, there also will generally be some varying amounts of both $C_3H_8$ (propane) and $C_3H_6$ (propene) hydrocarbons included in the liquid $C_3$, the ratio of the two species ranging from 100% $C_3H_8$ to 100% $C_3H_6$ by volume. Generally, $C_3H_8$ will be the predominant hydrocarbon. There may also be small amounts of contaminants in the liquid $C_3$ product, including some $C_{2-}$ materials and some $C_{4+}$ materials. The same is true for the LPG in stream (48) and in tank (80), which comprises liquid $C_4$. There will generally be amounts of both $C_4H_{10}$ (butane) and $C_4H_8$ (butane) hydrocarbons in the liquid $C_4$, the ratio of the two species ranging from 100% $C_4H_{10}$ to 100% $C_4H_8$ by volume. Generally, $C_4H_{10}$ will be the predominant hydrocarbon. There may also be small amounts of contaminants in the liquid $C_4$ product, including some $C_{3-}$ materials and some $C_{5+}$ materials.

A natural gas stream (44) which is also produced in the LPG separation zone (40) is combined with natural gas stream (36) from the first refrigeration zone (30) for additional cooling in the second refrigeration zone (50). LNG is recovered as a liquid stream (52) from the second refrigeration zone for storage in LNG storage vessel 60. In one embodiment of the process, LNG stored in 60 and LGP stored in 70 and 80 are maintained at nominally atmospheric pressure, the actual pressure being slightly higher than ambient pressure to account for the vapors which are being generated by the evaporating liquids and which are being vented from the storage vessels. The two $C_{5+}$ condensate streams (32) and (42), if present, may be combined or used separately in downstream processing, as fuel, as a petrochemical feedstock, and the like.

According to the present process, a slip stream from the LNG rundown product (52) is passed individually via line 54 to heat exchangers, called bayonet exchangers, shown as 74 and 84, respectively. The bayonet exchangers are suitably located within the storage vessels, such that the $C_3$ and $C_4$ vapors generated within the storage vessels pass over the bayonet exchangers in the vapor space of the storage vessel, thus eliminating all vapor lines external to the storage vessels. The chilled LNG which is used as the heat exchange medium within each exchanger is maintained at a temperature of around −160° F., such that the vapors generated within the storage vessels are condensed and returned to the liquid within the vessels. Use of these exchangers effectively reduces and controls the vaporization of $C_3$ and $C_4$ respectively entirely within their respective vessels and eliminates the need to pressurize the vapors in order to recondense them. Using LNG to condense the $C_3$ and $C_4$ boil off gases as illustrated in the drawing will cause some of the LNG to vaporize. The partially vaporized LNG product from the LPG chilling process is then returned via line 65 to the LNG storage vessel (60) where it is recycled for recovery with the LNG boil off gas by line 62 using conventional LNG BOG recovery.

Bayonet exchangers suitable for use with the invention are generally known in the art for heat exchange. See, for example, "Bayonet Exchangers", pages 738-745, of Process Heat Transfer by Ronald Q. Kern, May 1950, and in U.S. Pat. Nos. 5,128,292; 3,887,003; 4,431,049; 4,479,535; and 3,861,461. In U.S. Pat. No. 5,128,292 the bayonet exchanger is described generally as including a tube bundle wherein one end of the bundle is unattached, thereby minimizing problems due to the expansion and contraction of the heat exchanger components.

Figure 2:
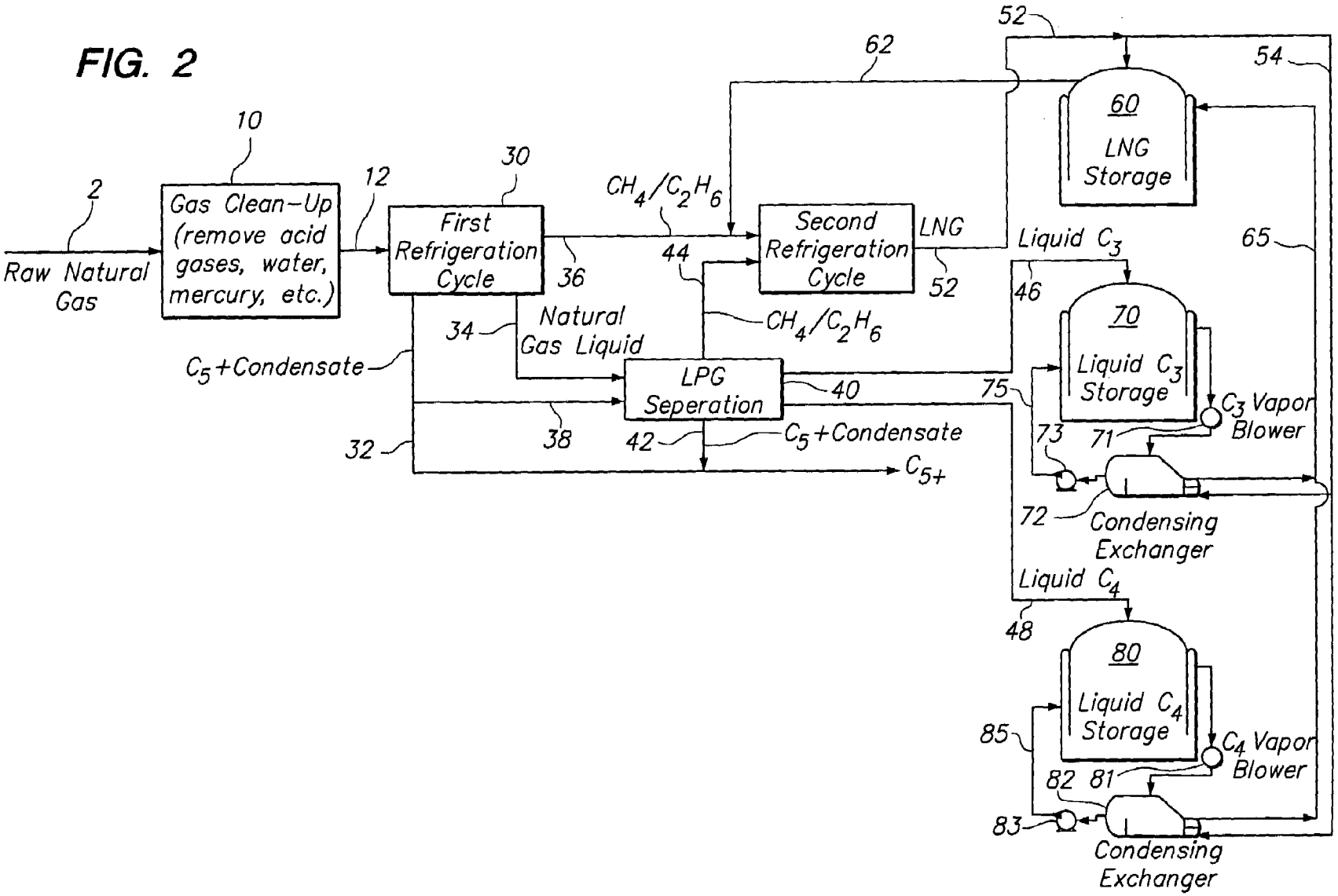
FIG. 2 is an alternative embodiment of a LNG/LPG liquefaction facility in which condensing exchangers located external to the propane and butane storage vessels are used to recover the boil off gases.

In a separate embodiment of the invention illustrated in FIG. 2, each of the LPG storage vessels is equipped with a separate condensing exchanger. Except for the LPG vapor recovery equipment, the configuration of the LNG/LPG liquefaction is the same as illustrated in FIG. 1, therefore, a detailed discussion of the similar portions of the diagram should not be necessary. A part of the LNG rundown product (52) is passed via line 54 to each condensing exchanger, shown as 72 for the $C_3$ storage vessel and 82 for the $C_4$ storage vessel, respectively, and the LPG liquids which are condensed pass via lines 75 and 85 with the help of pumps 73 and 83 back into the respective storage tanks (70 and 80) for the LPG. Vapor blowers servicing the $C_3$ and $C_4$ storage vessels shown as 71 and 81 may be needed to efficiently move the vapors through the exchangers. Condensing exchangers are known for use as heat exchangers, and their general use is taught in U.S. Pat. Nos. 5,177,979; 4,745,768; 4,446,703 and in U.S. Application Publication No. 2004/0182752.

What is claimed is:

1. A method of recovering $C_3$ boil off gas from a vessel containing liquefied $C_3$ which comprises contacting the $C_3$ boil off gas with a heat exchanger surface located which is cooled by contact with LNG and recovering a liquefied $C_3$ product therefrom, wherein the LNG used to cool the heat exchange surface is at least partially vaporized and the vaporized LNG is returned to an LNG storage vessel.

2. The method of claim 1 wherein the heat exchange surface is within a bayonet exchanger.

3. The method of claim 1 wherein the $C_3$ boil off gas is collected from the vessel and contacted with a heat exchange surface within a condensing exchanger.

4. The method of claim 1 wherein the liquefied $C_3$ is maintained at atmospheric pressure or above.

5. A method of recovering $C_4$ boil off gas from a vessel containing liquefied $C_4$ which comprises contacting the $C_4$ boil off gas with a heat exchanger surface which is cooled by contact with LNG and recovering a liquefied $C_4$ product therefrom, wherein the LNG used to cool the heat exchange surface is at least partially vaporized and the vaporized LNG is returned to an LNG storage vessel.

6. The method of claim 5 wherein the heat exchange surface is within a bayonet exchanger.

7. The method of claim 5 wherein the $C_4$ boil off gas is collected from the vessel and contacted with a heat exchange surface within a condensing exchanger.

8. The method of claim 5 wherein the liquefied $C_4$ is maintained at atmospheric pressure or above.

9. In a facility for liquefying LNG and propane which comprises an LNG liquefaction unit and a vessel for storing $C_3$, an improved method for recovering boil off $C_3$ gas from the vessel for storing $C_3$ which comprises contacting the $C_3$ boil off gas with a heat exchange surface cooled by LNG and recovering liquefied $C_3$ from the heat exchanger, and wherein the LNG used to cool the heat exchange surface is at least partially vaporized and the vaporized LNG is sent to the LNG liquefaction unit and recovered as LNG.

10. In a facility for liquefying LNG and $C_4$ which comprises an LNG liquefaction unit and a vessel for storing $C_4$, an improved method for recovering boil off $C_4$ gas from the vessel for storing $C_4$ which comprises contacting the $C_4$ boil off gas with a heat exchange surface cooled by LNG and recovering liquefied $C_4$ from the heat exchanger, and wherein the LNG used to cool the heat exchange surface is at least partially vaporized and the vaporized LNG is sent to the LNG liquefaction unit and recovered a LNG.

* * * * *